United States Patent [19]

Kramer, deceased et al.

[11] Patent Number: 4,716,508

[45] Date of Patent: Dec. 29, 1987

[54] OUTDOOR LIGHTING PEDESTAL

[76] Inventors: John F. Kramer, deceased, late of Palm Desert, Calif.; by Barbara B. Van Oosting, executrix, P.O. Box 2857, Palm Desert, Calif. 92261; by Karen S. Wessberg, executrix, 2469 Porthmoor, Corona, Calif. 91720

[21] Appl. No.: 791,928

[22] Filed: Oct. 28, 1985

[51] Int. Cl.[4] ..... F21S 1/10

[52] U.S. Cl. ..... 362/431; 362/277; 362/307; 52/722; 52/165

[58] Field of Search ..... 362/145, 152, 217, 277, 362/282, 307, 310, 311, 347, 363, 431, 280; 52/722, 152, 155, 165

[56] References Cited

U.S. PATENT DOCUMENTS

| | | | |
|---|---|---|---|
| 744,056 | 11/1903 | Emerson | 52/146 |
| 1,284,376 | 11/1918 | Lehman | 362/431 |
| 2,524,638 | 10/1950 | Salad | 362/280 |
| 3,267,274 | 8/1966 | Johnson | 362/282 |
| 3,421,473 | 1/1969 | Weichenrieder | 52/146 |
| 4,438,484 | 3/1984 | Winden | 362/311 |
| 4,443,834 | 4/1984 | Schafer et al. | 362/282 |
| 4,471,588 | 9/1984 | Schirm | 52/165 |
| 4,507,715 | 3/1985 | Wedding | 362/431 |

*Primary Examiner*—Craig R. Feinberg
*Assistant Examiner*—David A. Okonsky
*Attorney, Agent, or Firm*—I. Louis Wolk

[57] ABSTRACT

A pedestal especially adapted for outdoor uses for supporting an electric lighting fixture is formed of precast concrete or similar material and formed with a concentric opening or chose to permit incorporation of electrical connectors therein. Said pedestal may be frustoconical in shape and may be provided with a supporting collar adapted to engage it at its base or at ground level. Further, said pedestal may be provided with an electrical fixture having vertical or horizontally positioned cylindrical lenses of special design. The pedestal described may be positioned with its base at or below ground level as desired.

6 Claims, 10 Drawing Figures

OUTDOOR LIGHTING PEDESTAL

BACKGROUND OF THE INVENTION

The present invention relates to pedestals for supporting and incorporating outdoor lighting fixtures and to novel lighting fixtures attached thereto.

Most outdoor lighting means which are positioned in yard or garden areas unattached to building structures are in the form of fixtures attached to spikes which are embedded in the ground or to boxes attached to conduits in which wiring connections to the fixtures are provided through buried conduits.

Such lighting devices may not only be unsightly but are readily disrupted by contact with lawn mowers or other equipment and are subject to corrosion and adverse weather conditions. In addition, the manner of mounting and connecting lighting fixtures is difficult to accomplish and frequent maintenance may be required for continuous operation.

OBJECTS AND SUMMARY OF THE INVENTION

This invention relates to a precast concrete outdoor lighting monument and lighting fixtures attached thereto in a form which permits portability of units and easy installation and connection. The units of the present invention are formed into frusto-conical or cylindrical members of the desired dimensions by precasting concrete or plastic compositions in a manner which will provide a central chase for conduction and interconnection of wires or cables.

These units are provided at their apex with means for supporting or enclosing various types of lighting members.

The precast units described are primarily intended to be installed with a base portion below grade to the extent desired or necessary, usually 10–15 inches deep, although in the case of the frusto-conical configuration, the units are sufficiently stable to be supported directly on the ground or embedded only slightly.

In addition, where additional above or below ground stability is required, a precast collar or sleeve having a central opening conforming in dimensions to the base area of the unit and itself having substantial weight may be provided to be slipped over the unit in engagement with the base to provide greater resistance to movement or deflection.

While conventional types of lighting fixtures may be mounted upon the pedestals described herein, the invention also includes a novel type of cylindrical lighting fixture mounted on its horizontal axis attached at its curved surface to the apex or top surface of the pedestal, and especially adapted for use with such pedestals.

It is, therefore, an object of this invention to provide a stable, durable and weather resistant pedestal for mounting outdoor lighting fixtures with an integrally formed central chase for electrical connectors.

It is a further object of the invention to provide auxiliary means for supporting and stabilizing said pedestals utilizing a present sleeve or collar which anchors the pedestal at its base.

It is a still further object of the invention to provide a novel type of lighting fixture suitable for attachment to the apex or top surface of the pedestal.

These and other objects of the invention are more fully described below and in the appended drawings.

BRIEF DESCRIPTIONS OF THE DRAWINGS

Figure 1:
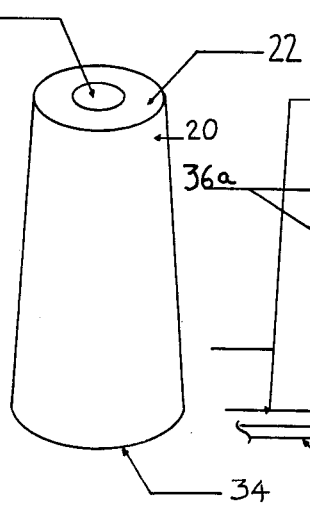
FIG. 1 is a view in elevation of the pedestal base prior to placement and mounting of an electric fixture thereon.

FIG. 1 describes a frusto-conical pedestal 20 or outdoor fixture support formed by precasting concrete or a suitable plastic composition in a mold with a core to form a concentric hollow chase 21 to permit incorporation of electrical wiring as described further below. The top surface 22 is smooth to provide anchoring for a suitable type of lighting fixture as described herein. The shape as shown with its wide base and the weight of the unit provides a high degree of stability whether positioned at ground level or partially embedded in the soil. The base may also be cylindrical with the same concentric chase but the conical configuration permits a greater degree of stability.

Figure 2:
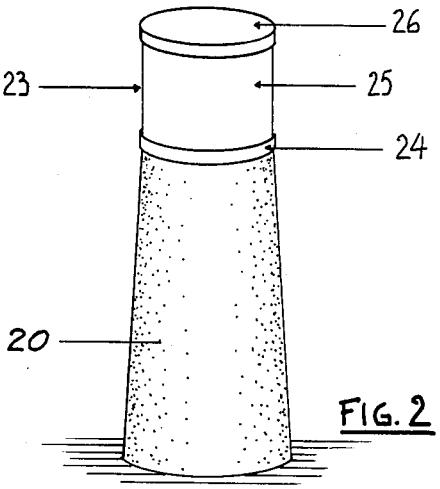
FIG. 2 is a view in elevation of a pedestal of the invention with one type of fixture positioned thereon.
Figure 6:
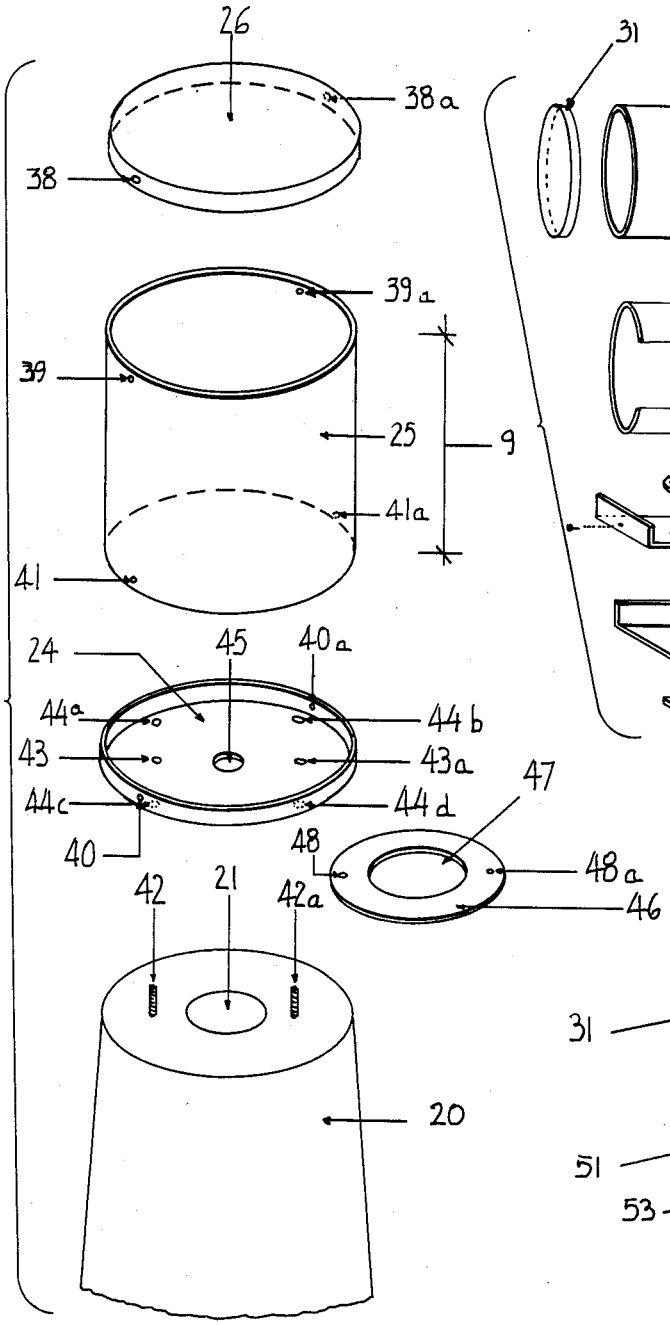
FIG. 6 is an "exploded" view in elevation showing the assembly of FIG. 2 with details of the fixture.

As shown in FIG. 2 pedestal 20 may be provided with a vertical cylindrical fixture 23 mounted on a base 24 attached to the top of the pedestal with transparent cylindrical lens 25 supported between base 24 and a cover 26 as described in greater detail in FIG. 6.

Figure 3:
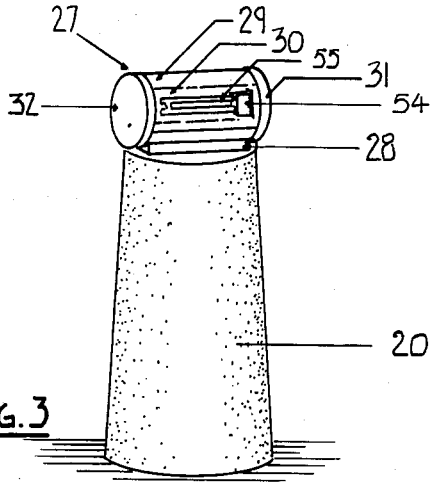
FIG. 3 is a view of elevation of the pedestal with another type of fixture positioned thereon.
Figure 9:
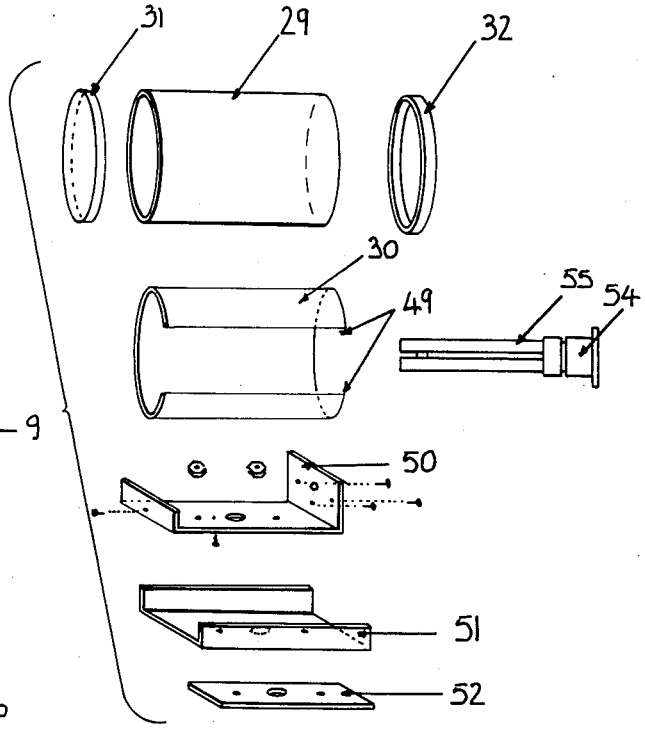
FIG. 9 is a view in elevation showing a pedestal supported by a supporting collar or sleeve inserted thereover and anchoring the base of the pedestal.
Figure 10:
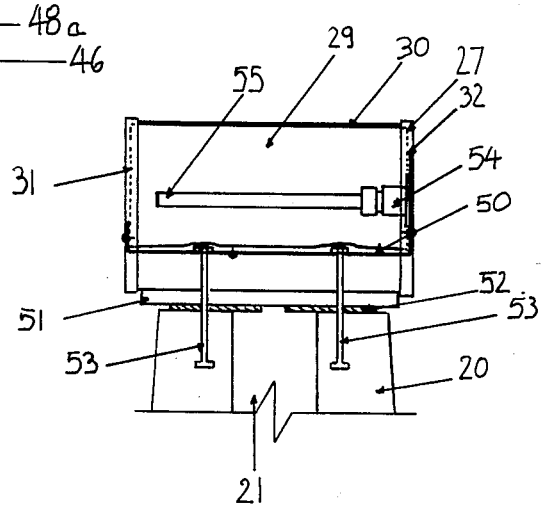
FIG. 10 is a view in outline corresponding to FIG. 7 showing the position of the collar.

FIG. 3 shows the pedestal 20 with cylindrical fixture 27 designed to be supported on top of the pedestal horizontally on its side edge supported on a base 28 attached to the pedestal. The fixture is provided with a transparent cylindrical lens provided with a semi-cylindrical reflector and end caps of metal or plastic 31 and 32, as described below in greater detail with reference to FIGS. 9 and 10.

Figure 4:
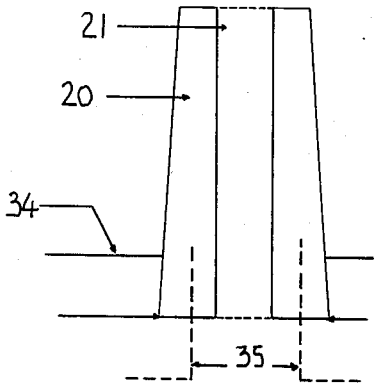
FIG. 4 is a view in outline of the pedestal in position.

FIG. 4 shows the pedestal 20 with its central core opening or chase 21 positioned partially embedded below ground level 34. As shown in dotted lines 35 bracing or supporting by a plurality of rods 35 which may be preliminarily embedded in the concrete during setting and bent outward to provide additional support for the pedestal.

Figure 5:
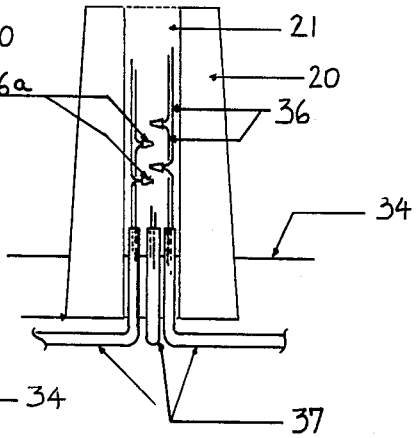
FIG. 5 is a view in outline of the pedestal in position with electrical connection therein.

FIG. 5 illustrates the manner of utilizing the core 21 of the pedestal 20 as a chase for housing the electrical connections 36 and **36*a* shown being carried into the core from underground conduits 37**.

FIG. 6 describes the fixture of FIG. 2 and mounting thereon in "exploded" outline. As shown lens 25 is exposed between base 24 and cap 26 and fastened thereto by means of screws (not shown) engaging openings 38, **38*a*, and 39 and 39*a* at the upper edge, and 40, 40*a* and 41, 41*a* at the lower edge. The base plate 24 is attached to the upper surface of the pedestal by means of bolts 42, 42***a* screwed therein and engaging the box plate through corresponding openings 43, 43*a*. Additional openings 44*a, b, c, d* may be provided for supporting a base for an electrical socket (not shown) connected through opening 45 in the base plate. A cushioning gasket 46 with a central opening 47 may be positioned between the base plate and the pedestal and clamped therebetween using bolts 42 and 42*a* through openings 48, 48*a*.

Figure 8:
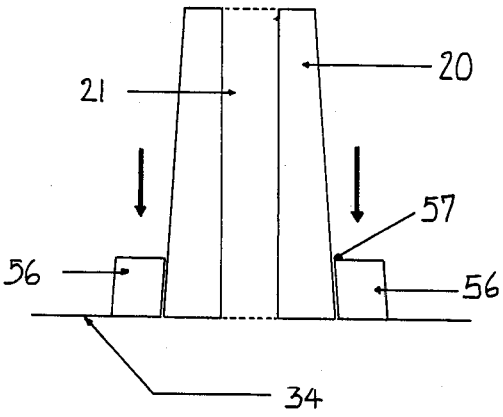
FIG. 8 is an "exploded" view in outline showing the components of the fixtures of FIGS. 1 and 9.
Figure 7:
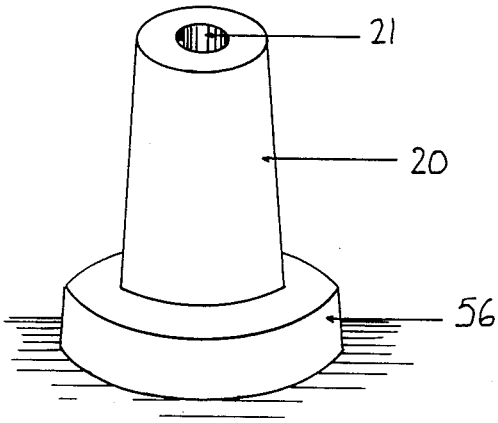
FIG. 7 is a view in outline showing the assembled fixture shown in FIG. 1 on the pedestal in detail.

FIG. 7 shows the cylindrical fixture of FIG. 2 in detail while FIG. 8 shows the elements of FIG. 7 separated in an "exploded" manner. As illustrated fixture 27 is composed of transparent cylindrical lens 29 mounted between end plates or caps 31,32. Positioned within the cylindrical lens adjacent to its inner surface is a manually slidable reflector 30 in the form of a thin sheet of reflective material, i.e., thin polished sheet metal or metallized plastic such as mylar shaped in a ganerally cylindrical manner but with a longitudinal open segment 49 to reflect light therethrough having an opening selected to reflect as much light as desired as shown in FIG. 8. This reflector is sufficiently springlike to frictionally engage the inner surface of the lens and to be manually slidable to adjust the position of the open segment to reflect light in the desired direction. The lens and end cap assembly is mounted upon a bracket 50 by screws engaging the caps at each end and the bracket is attached to a base 51 and a gasket and in turn to pedestal 20 by means of bolts 53 embedded in the pedestal and engaging the bracket as shown in FIG. 7. The supporting bracket is provided with an electrical socket 54 designed to accommodate an elongated bulb 55, i.e., fluorescent.

As shown, openings are provided in the gasket bracket and bracket base for accommodating wiring from chase 21 to the bulb socket.

Referring to FIGS. 7 and 8, pedestal 20 with its central chase 21 is shown resting with its base directly upon the ground. To provide more solid anchoring and support a collar 56 is preformed with an opening 57 with a tapered contour to snugly fit the base of the pedestal, frusto-conical contour as shown in FIG. 8. This collar may also be of precast concrete or the like and is of sufficient weight to provide adequate support. Although as shown, the pedestal and collar are positioned on the ground level, the pedestal may be inserted below ground with sufficient space around it to permit positioning of the collar adjacent to its base below ground level. In a variation, the base of the pedestal may be positioned below ground level and the collar preformed to have its opening conform to the diameter of the pedestal at ground level and slipped over it to rest at ground level and provide support in that manner. The opening in said collar will conform to the shape of the pedestal but otherwise the collar may have any cleared outer shape such as rectangular, circular, hexagonal or the like.

The dimensions of the pedestal may vary as desired but for practical purposes it may have a base diameter of 8–12 inches and a top diameter of 4–10 inches and a height of 16–36 inches. The central chase may be from 2–3 inches in diameter. In the case of a cylindrical or rectangular pedestal or any other shape, the dimensions would be of a similar order of magnitude and the collar would have a central opening conforming closely to those of the pedestal base. The collar, itself, may have a diameter of 3–8 inches greater than the base of the pedestal and a thickness sufficient to provide the necessary weight and rididity, say 2–6 inches.

What is claimed is:

1. A pedestal for supporting an electric lighting fixture which comprises an upright member formed of a dense composition having a central base for accommodation of electrical wiring extending centrally therethrough, said pedestal being in the form of a frustum of a cone with a wide base adapted to rest upon the ground and an uppermost narrow surface adapted to receive said lighting fixture wherein a vertically slidable supporting collar is positioned around said pedestal at a level at which its base is supported upon the ground, a central opening in said collar conforming closely to an outer diameter of the pedestal at said level.

2. A pedestal according to claim 1 wherein the opening in said collar has a tapered shape to conform and closely engage said pedestal at its level of ground support.

3. A pedestal according to claim 1, wherein said pedestal is positioned with its base below ground level and a vertically, slidable supporting collar having an inner diameter conforming to an outer diameter of the pedestal at ground level is positioned around said pedestal at ground level to provide support for said pedestal.

4. A pedestal according to claim 1 in which said lighting fixture comprises a cylindrical lens supported along its horizontal axis upon a support attached to said uppermost narrow surface of said pedestal, said lens being provided with an internally positioned rotatable reflector in the form of a sheet of reflective material of cylindrical configuration conforming to the inner surface of said lens and having a longitudinal slit opening therein to permit the escape of light from said lens.

5. A lighting fixture adapted to be mounted upon a pedestal which comprises, a cylindrical transparent lens, means for supporting said lens with its longitudinal axis in a horizontal position, a rotatable reflector in slidable contact with said lens having a cylindrical configuration and positioned concentric with said lens, said reflector having an elongated longitudinal slot extending lengthwise thereof to permit passage of light therethrough, said reflector being formed of reflective sheet material.

6. A pedestal for supporting an electric lighting fixture which comprises an upright vertically positioned member having a central base for accommodation of electrical wiring therein, said upright member having said base adapted to rest upon the ground, and a vertically slidable supporting collar in the form of a sleeve of substantial weight surrounding said pedestal at a point at which the upright member engages the ground, said collar having an inner shape and diameter conforming closely to the outer diameter of said upright member at the point of ground engagement.

* * * * *